United States Patent [19]

Ambasz

[11] Patent Number: 4,613,930

[45] Date of Patent: Sep. 23, 1986

[54] CEILING LIGHTING FIXTURE AND SYSTEM

[76] Inventor: Emilio Ambasz, 295 Central Park West, New York, N.Y. 10024

[21] Appl. No.: 772,649

[22] Filed: Sep. 4, 1985

[51] Int. Cl.[4] ..... F21S 3/00

[52] U.S. Cl. ..... 362/223; 362/225; 362/147; 362/326

[58] Field of Search ..... 362/223, 225, 217, 147, 362/326, 329, 331, 332

[56] References Cited

U.S. PATENT DOCUMENTS 4,282,564 8/1981 McJunkin, Jr. et al. ..... 362/217

4,338,653 7/1982 Marrero ..... 362/223

*Primary Examiner*—E. Rollins Cross

*Attorney, Agent, or Firm*—Brumbaugh, Graves, Donohue & Raymond

[57] ABSTRACT

A ceiling lighting fixture includes a pair of identical elongated side frame members and identical end plates, the side frames being generally L-shaped in transverse cross section and arranged to form upwardly opening channels which support the lamp socket mounting plate between the upper free ends of the inner legs thereof and a translucent fabric diffuser between the upper free ends of the outer legs thereof. The fabric diffuser may hang freely as a catenary or it may be weighted to form a V-shape. The electrical power lines to the lamps extend along one of the L-shaped channels. Two or more of the fixtures may be joined together at their ends, either end-to-end or through a central module, to provide a ceiling lighting system.

9 Claims, 4 Drawing Figures

CEILING LIGHTING FIXTURE AND SYSTEM

BACKGROUND OF THE INVENTION

Ceiling lighting is, of course, widely used, especially in building space dedicated to commercial or institutional use, such as offices, stores, restaurants and schools, to name a few examples. By far the most common type of ceiling lighting in offices, stores and schools is provided by ceiling fluorescent tubes, which are well suited to providing a diffuse and high level of illumination. Incandescent lamps are used by restaurants, where softer, warmer and lower intensity lighting is desired. Nearly all ceiling lighting fixtures, both fluorescent and incandescent, include some sort of diffuser. Notwithstanding the implication of the term "diffuser," i.e., that a diffuser is used to spread the light from the tube or bulb or the lamp or lamps of the fixture throughout the room, the main function of the diffuser is to hide the tubes or bulbs so people in the room cannot see the intense light of the lamps themselves, especially in the case of incandescent lamps. The most common diffusers are translucent glass or plastic plates, boxes or gloves or some form of grille suitably fastened to the lamp holder. To a greater or lesser extent, such diffusers have a decorative function, but the opportunity for enhancement of the decorative characteristic of diffusers of presently known forms is somewhat limited by the nature of the materials (glass, plastic and, in the case of grilles, metal).

SUMMARY OF THE INVENTION

In accordance with the present invention, there is provided an improved ceiling lighting fixture having a rectangular frame including a pair of elongated side members and a pair of end plates. The side members are generally L-shaped in transverse cross section and are oriented with the junctures between the legs lowermost and in a common plane, the outer leg of each side member, relative to the space within the frame, being further oriented obliquely to the plane of the junctures so that the two outer legs converge downwardly. A lamp socket mounting plate, with sockets and lamps opening through the underside thereof, is carried by and extends between the upper free ends of the inner legs of the frame side members. A rectangular strip of translucent fabric is suspended by its side edges from the upper free ends of the outer legs of the frame side members and hangs below the lamp socket mounting plate as a diffuser. The diffuser fabric may hang freely, in which case it assumes the shape of a catenary, or a glass rod or the like may be placed in the fabric to cause it to assume a V-shape. The use of a fabric diffuser greatly enhances the variety of colors, patterns, and other decorative effects that may be employed relative to prior art diffusers.

A further advantage of the invention is that the frame side members and the end plates may have respectively identical constructions, thereby reducing manufacturing and inventory costs. The upwardly-opening orientation of the L-shaped frame members also provides a ready channel-like configuration for placement of electrical power lines and connections to the lamp circuits.

In accordance with another feature of the invention, two or more of the above-described lighting fixtures may be clustered together to provide a lighting system. A preferred arrangement is to connect two, three, or four fixtures to respective sides of a square central module in mutually perpendicular relation. The sides of the module may have the identical shape as the end plates of the fixtures, and indeed may entirely replace the end plate at the fixture end joined to the module. Alternately, module corner segments of pyramidal shape may be connected on two sides to the adjoining L-shaped side frame members of the adjacent fixtures. In this case, the sides of the module segments need only be generally coextensive with the cross-sectional extent of the L-shaped frame members, and for decorative purposes preferably are congruent with the legs of the L-shaped members.

BRIEF DESCRIPTION OF THE DRAWINGS

For a better understanding of the invention, reference may be made to the following description of an exemplary embodiment thereof, taken together with the accompanying drawings, in which.

DETAILED DESCRIPTION

Figures 1, 2:
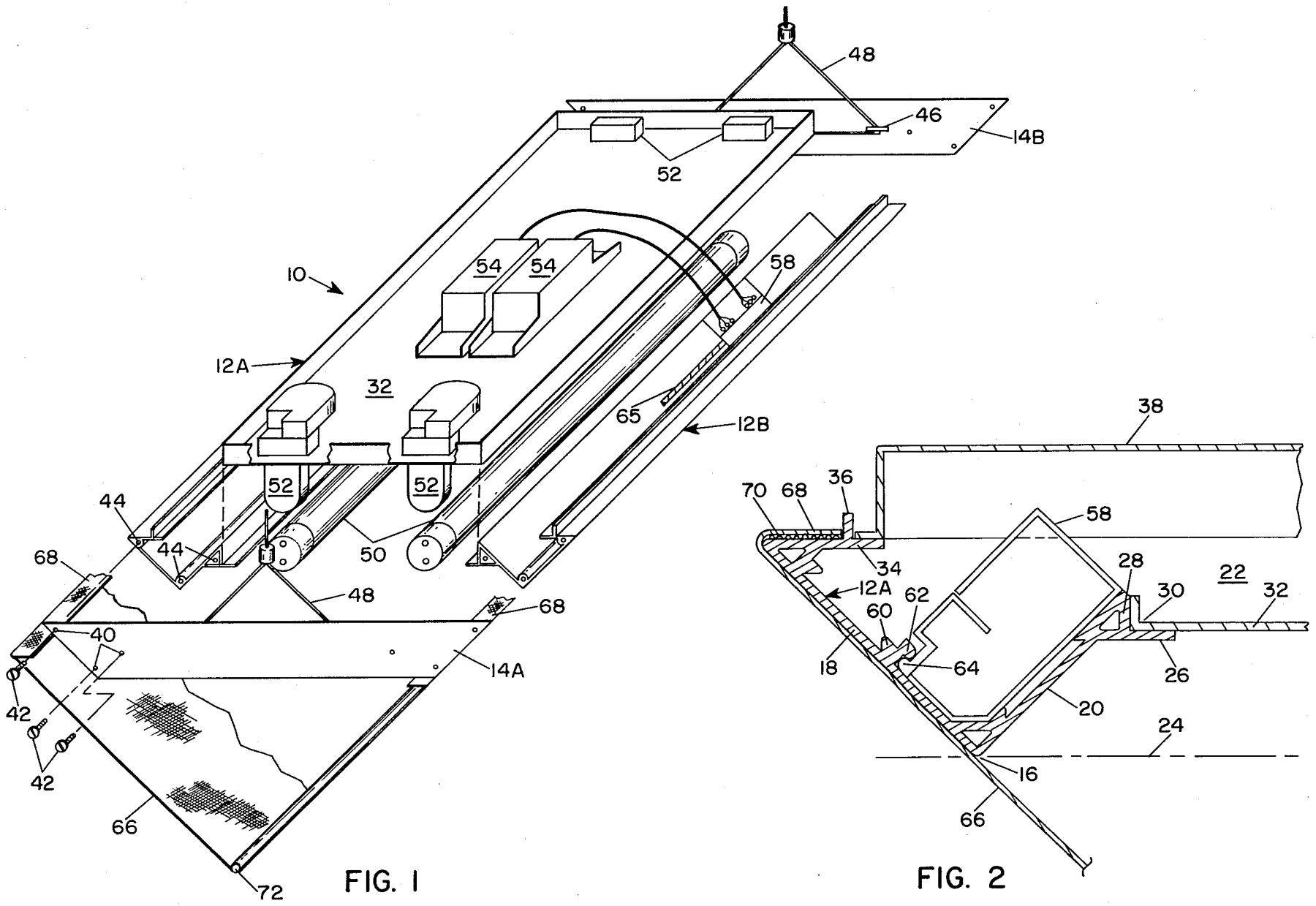
FIG. 1 is an expanded perspective view of one embodiment of a ceiling lighting fixture constructed in accordance with the invention.
FIG. 2 is a partial transverse sectional view of the lighting fixture of FIG. 1, showing the transverse cross section of the left-hand side member and the manner of connection therewith of the lamp socket mounting plate and the diffuser.

In the embodiment illustrated in FIGS. 1 and 2, the ceiling lighting fixture indicated generally at 10 includes a generally rectangular frame made up of a pair of elongated side members 12A and 12B and a pair of end plates 14A and 14B. For economy of manufacture and inventory, the two side members 12A and 12B and the two end plates 14A and 14B preferably are identical. The may be formed of any material suitable for lighting fixtures, such as aluminum or other lightweight metal or plastic.

Each side member is generally L-shaped in transverse cross section and of uniform cross section throughout its length. The side members are arranged so that, with reference to member 12A in FIG. 2, the juncture 16 of the legs 18 and 20 is lowermost and the outside leg 18, relative to the space 22 within the frame, is oriented obliquely to the plane 24 containing the junctures 16 to slope downwardly and inwardly towards the other elongated side member. At its upper end, the inner leg 20 of each frame member 12A, 12B is formed with an inwardly extending flange 26 and an upstanding shoulder 28 for receipt of the adjacent longitudinal edge 30 of a generally rectangular lamp socket mounting plate 32. The upper end of the outer leg 18 of each frame member 12A, 12B similarly includes an inwardly extending flange 34 and upstanding shoulder 36 for support of a rectangular cover member 38.

As shown in FIG. 1, the end plates 14A and 14B are preferably trapezoidal in shape and are predrilled, as illustratively indicated at 40, for the receipt therethrough of sheet metal screws 42. The openings 40 are arranged relative to preformed openings 44 in the frame members 12A and 12B to provide the desired alignment and orientation of the frame members 12A and 12B. Each end plate 14A and 14B is formed on its side with a pair of brackets 46, only one of which is shown in FIG. 1, for purposes of suspending the fixture from the ceiling by means of a cord or cable 48 looped over the brackets 46. Other suspension systems may, of course, be used in place of the brackets 46 and cables 48.

In the embodiment illustrated in FIG. 1, the lamp socket mounting plate 32 is shown as carrying on its underside a pair of conventional fluorescent tubes 50 and associated mounting sockets 52. The usual ballast and starting circuits 54 for the tubes 50 are mounted on the upper surface of the plate 32 and connected by electrical leads 56 to a junction box 58 carried by the frame member 12B. If desired, and as shown in FIG. 2, the frame member 12B (or both side members) may be formed with a longitudinally extending shoulder 60 to define with the leg 20 a channel for the snap-in mounting of the junction box 58. To that end, the shoulder 60 and box 58 may be provided with cooperating mutually engageable lips 62 and 64, respectively. With this construction, the junction box 58 may be readily installed at any convenient location along the length of the frame members 12A and 12B. External power may be supplied to the junction box 58 via a line 65 located in and extending along the upwardly facing channel formed by the legs 18 and 20 of the frame side member, e.g., 12B carrying the junction box 58.

As a feature of the invention, the ceiling fixture further includes a light diffuser 66 in the form of a rectangular strip or sheet of translucent fabric of generally the same length as the side frame membrs 12A and 12B but of greater width than the plates 14A and 14B. The fabric is attached along its lengthwise edges 68 to the outer upper surfaces of the flanges 34 located at the free ends of the outer legs 18 of the frame members 12A and 12B. For ease of assembly and disassembly, this connection is preferably of the hook-and-loop type, as indicated at 70 in FIG. 2, the mating parts of which are affixed to the fabric edges 70 and the upper surfaces of the flanges 34, respectively. Other types of fasteners may be used if desired.

The fabric diffuser 66 may hang freely from the frame members 12A and 12B, in which case it assumes the shape of a catenary, or a glass rod 72 or the like may be placed in the diffuser to cause the diffuser to assume a V-shape. For enhanced appearance, the width of the diffuser 66 is preferably such that the fabric will be aligned with the outer legs 18 of the frame members 12A and 12B, as shown in FIG. 2, when the rod 72 is in place.

Figure 3:
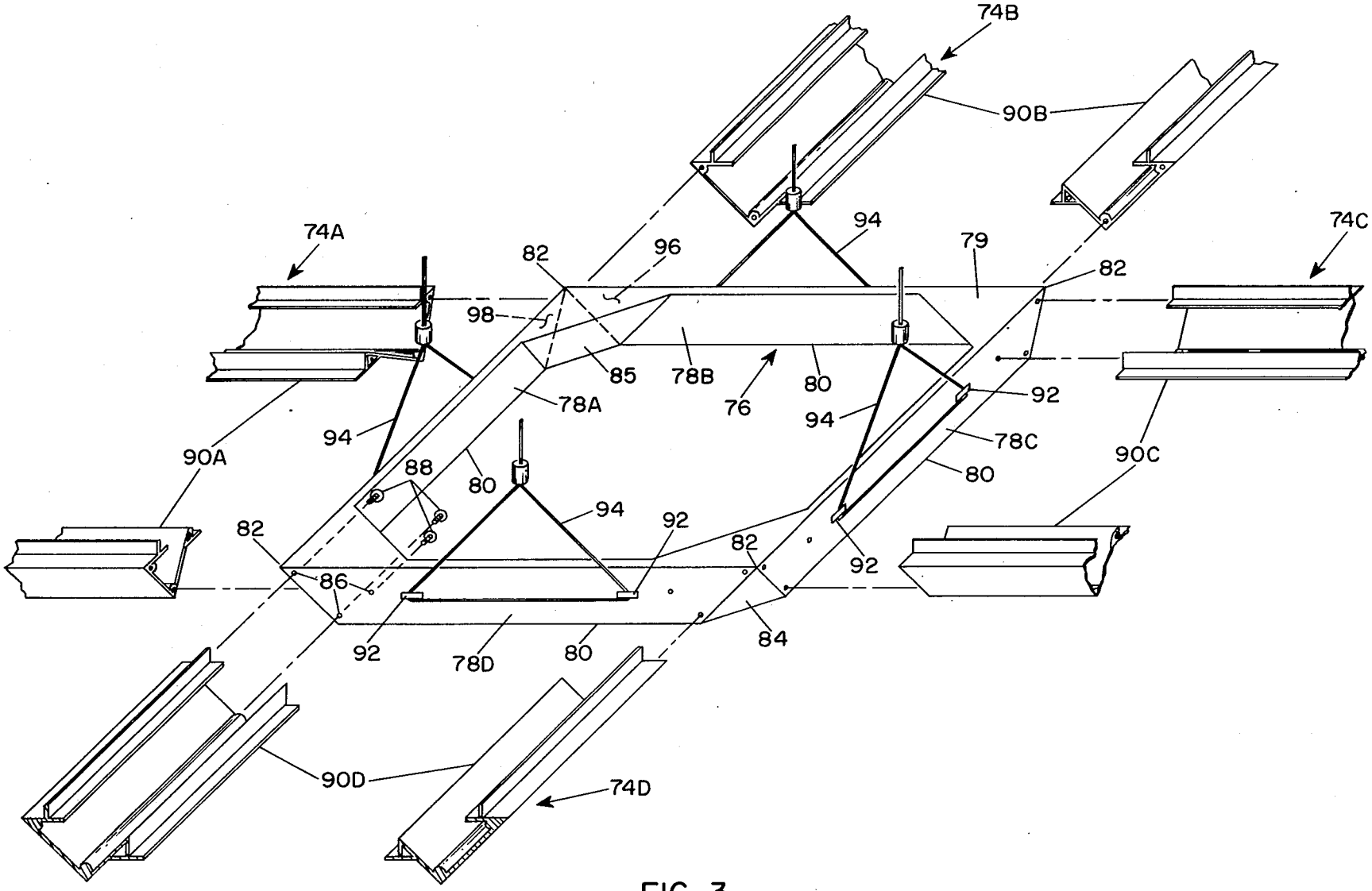
FIG. 3 is an expanded perspective view of a ceiling lighting system built up, in accordance with the invention, from a plurality of lighting fixtures as shown in FIG. 1.

The ceiling lighting fixture of FIG. 1 may be used as an independent fixture or, in accordance with another feature of the invention, may be clustered together in units of two or more fixtures to provide a lighting system. The manner in which the fixtures may be joined together is illustrated in FIG. 3, which depicts a cross-shaped system of four fixtures 74A, 74B, 74C and 74D arranged around a central connecting frame or module 76.

The module 76 suitably includes four identically-shaped sides 78A, 78B, 78C and 78D of the same size and configuration as the end plates 14A and 14B of FIG. 1. The sides 78A–78D are aligned with the lower edges 80 in a common plane and are joined at their upper corners 82 to form a square. A triangular plate 84 is provided at each corner of the module 76 to join the ends of adjacent sides 78A–78B, 78B–78C, 78C–78D, etc., and close the circumference of the module 76. A partial top plate 79 may be provided to lend increased rigidity to the module. Trapezoidal plates 85 may be provided at each internal corner of the module 76 to enhance its appearance from below.

As with the end plates 14A, 14B of FIG. 1, the sides 78A–78D are preferably predrilled, as at 86, for receipt of sheet metal screws 88 to attach the pairs 90A, 90B, 90C and 90D of fixtures frame members (12A, 12B in FIG. 1) to the central module 76. If desired, the end plates (14A, 14B in FIG. 1) may be omitted from the ends of the fixture frame members 90A–90D adjacent the module 76 and the members 90A–90D connected directly to the corresponding module side members 78A–78D as illustrated in FIG. 3. Suspension brackets 92 and cables 94 may be provided on the side members 78A–78D in the same manner as described in connection with FIG. 1. The interior corner plates 85 are suitably secured in a conveniently removable manner to facilitate the insertion of the screws 88 for attachment of the fixtures 74A–74D to the module 76.

Alternatively, the end plates 14A, 14B may be attached to the fixture side frame members 12A, 12B as in FIG. 1, with the end plates thereafter being bolted or otherwise received on the module 76 in any suitable way. In this case, the side members 78A–78D are not strictly necessary and may be replaced by pyramidal-shaped segments comprised of the plates 84 and 85 and the two triangular-shaped side pieces 96 and 98 attached thereto. Preferably, the side pieces 96 and 98 are sized and shaped to be generally congruent with the legs 18 and 20 of the frame side members 12A and 12B (see FIG. 2) over the transverse cross-sectional extent of the members 12A and 12B.

Although FIG. 3 illustrates a lighting system having four fixtures clustered around the central connecting module 76, it will be apparent that other system configurations may be provided as desired by use of two or three fixtures. For example, an L-shaped system could be formed by connecting fixtures to two adjacent sides, e.g., 78A and 78B or 78B and 78C, etc., of the module 76. In ths case, the module 76 itself need not be square, but could instead take the form of a right triangle. Optionally, a pyramidal-shaped segment as aforementioned could be used to connect the adjoining side frame members of the two fixtures.

In another embodiment, fixtures could be connected only to opposite sides of the module, e.g., 78A and 78C or 78B and 78C, to provide an elongated system. In such case, still another alternative would be to butt two fixtures end to end and connect the facing end plate 14A, 14B of one directly to the facing end plate 14B, 14A of the other. As many fixtures can be connected in line in this way as desired, with electrical power being readily extended by running the power lines along the channels formed by the side frame members 12A, 12B. A further system configuration may be obtained by connecting fixtures to three adjacent sides of the module 76, e.g., sides 78A, 78B and 78C, to provide a T-shaped cluster. Here, again, pyramidal-shaped segments could be usd to connect the adjoining fixture side frame members in lieu of a full module 76.

Figure 4:
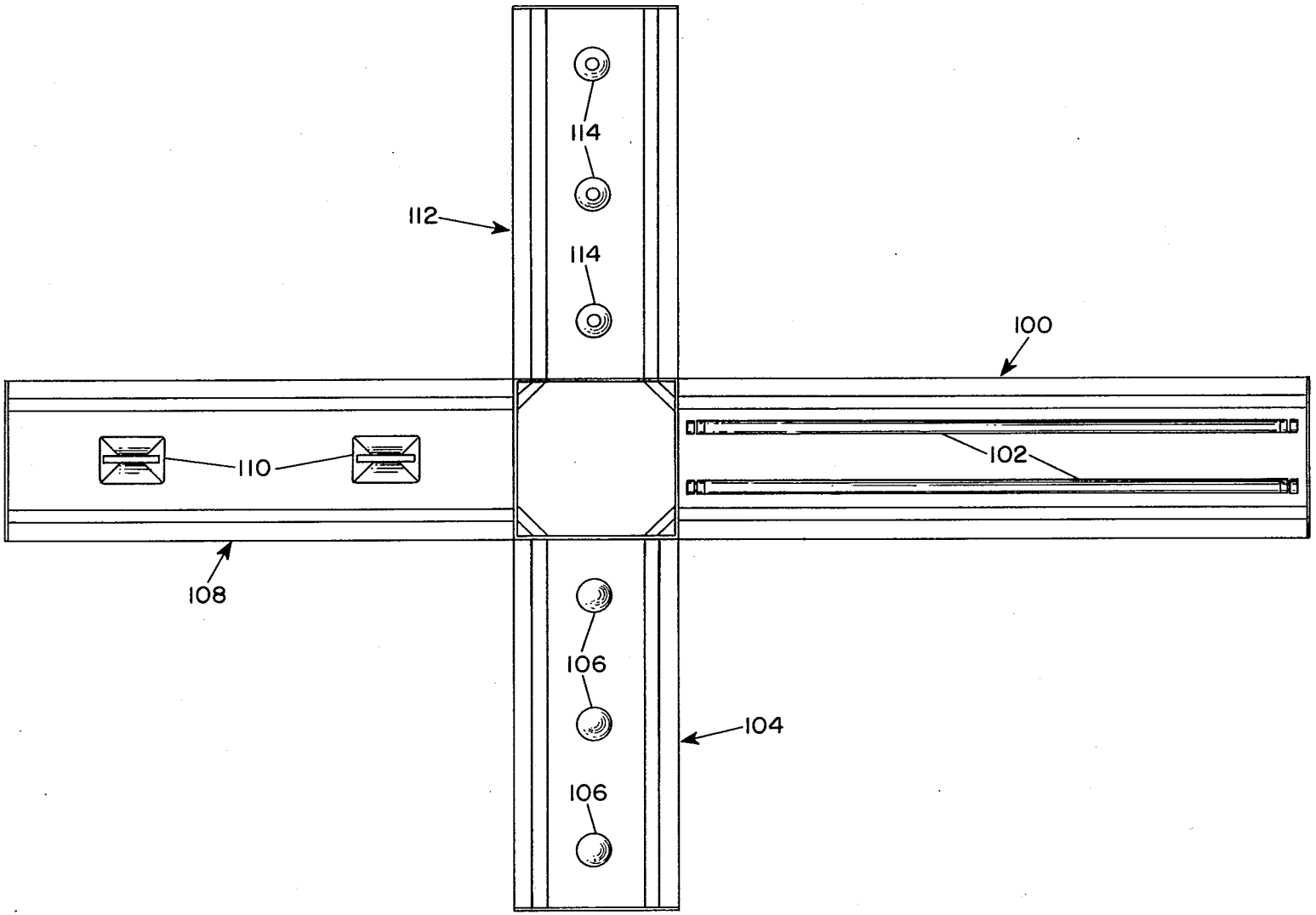
FIG. 4 is a bottom view of a ceiling lighting system illustrating the different types of lamps that may be used in the fixtures of the system in accordance with the invention.

The ceiling lighting fixture and system of the invention is in no way limited to the type of lamp used. This is exemplified by FIG. 4, which for illustrative purposes shows four different types of lamps in a cross-shaped lighting system. Fixture 100 depicts fluorescent tubes 102, fixture 104 traditional incandescent bulbs 106, fixture 108 halogen lamps 110, and fixture 112 recessed spot-type lamps 114.

Although the invention has been described and illustrated herein by reference to specific embodiments thereof, it will be understood by those skilled in the art that such embodiments are susceptible of modification and variation without departing from the inventive concepts disclosed. All such modifications and variations, therefore, are intended to be included within the spirit and scope of the appended claims.

I claim:

1. A ceiling lighting fixture comprising a rectangular frame having a pair of elongated side members and a pair of end plates, the side members being generally L-shaped in transverse cross section and of uniform cross section along their lengths and being oriented with the juncture between the legs lowermost and with the outer leg, with respect to the space within the frame, oriented obliquely to a plane that includes the junctures, a lamp socket mounting plate received on the frame and carrying sockets and lamps on the underside thereof, and a diffuser constituted by a rectangular strip of translucent fabric attached along each side to the upper free ends of the respective outer legs of the side members and hanging below the lamp socket mounting plate and the lamps.

2. A fixture according to claim 1 wherein the diffuser fabric strip hangs freely as a catenary.

3. A fixture according to claim 1 and further comprising a rod carried by the diffuser fabric strip and by its weight shaping the strip into a V-shape.

4. A fixture according to claim 1 and further comprising electric wires for energizing the lamps carried in at least one of the upwardly opening channels defined by the legs of the side members.

5. A ceiling lighting system, comprising:

two or more ceiling lighting fixtures, each fixture including (1) a pair of parallel elongated side members of generally L-shaped transverse cross section, the side members being oriented with the junctures between the legs lowermost and with the outer leg, with respect to the space between the side members, oriented obliquely to a plane containing the junctures, (2) at least one end plate joining the elongated side members, (3) a lamp socket mounting plate received on the elongated side members, and (4) a diffuser constituted by a translucent fabric attached along its opposite edges to the upper free ends of the respective outer legs of the side members and hanging below the lamp socket mounting plate; and a module for connecting adjacent ones of said two or more fixtures together in mutually perpendicular relation, said module comprising at least two perpendicular adjacent sides, said sides being connected to at least the respective adjoining L-shaped side members of the adjacent fixtures and being generally congruent with the legs of said L-shaped side member over the cross-sectional extent of the L-shaped member.

6. A system according to claim 5 wherein the sides of the connecting module are substantially identical in shape to an end plate of the fixtures and are connected to both of the L-shaped side members of the respective fixtures to which they are connected.

7. A system according to claim 5 wherein said connecting module is substantially square and each side thereof is substantially identical in shape to an end plate of the fixtures connected thereto.

8. A system according to claim 7 wherein a fixture is connected to each side of the connecting module to provide a cross-shaped lighting system.

9. A system according to claim 7 further comprising means carried by the sides of the connecting module for suspending the module and the fixtures connected thereto from the ceiling.

* * * * *